United States Patent [19]

Hellman

[11] Patent Number: 4,516,724

[45] Date of Patent: May 14, 1985

[54] SPRAYING DEVICE

[76] Inventor: Gösta Hellman, Svedjevägen 21, 436 00 Askim, Sweden

[21] Appl. No.: 432,927

[22] PCT Filed: Jan. 29, 1982

[86] PCT No.: PCT/SE82/00024

§ 371 Date: Sep. 28, 1982

§ 102(e) Date: Sep. 28, 1982

[87] PCT Pub. No.: WO82/02501

PCT Pub. Date: Aug. 5, 1982

[30] Foreign Application Priority Data

Jan. 29, 1981 [SE] Sweden ..... 8100603

[51] Int. Cl.[3] ..... B05B 15/02

[52] U.S. Cl. ..... 239/119; 239/600

[58] Field of Search ..... 239/119, 600; 403/48, 403/49

[56] References Cited

U.S. PATENT DOCUMENTS 3,831,862 8/1974 Calder ..... 239/119
3,954,344 5/1976 Nakama ..... 403/348 X
3,955,763 5/1976 Pyle et al. ..... 239/119
4,165,836 8/1979 Eull ..... 239/288 X

FOREIGN PATENT DOCUMENTS 1301879 11/1971 United Kingdom ..... 403/349
2079184 7/1981 United Kingdom ..... 239/600

*Primary Examiner*—Andres Kashnikow
*Assistant Examiner*—Kevin Patrick Weldon

[57] ABSTRACT

A spraying device comprising a spray nozzle holder mountable in a holder housing and having two mounting elements extending in opposite directions from the nozzle in the holder and transverse to the housing, one of these elements being a rotatable handle. The housing has two openings located substantially opposite each other for accommodating the respective mounting element; at least one opening having a width which is less than the width of the holder in the vicinity of the nozzle, and at least one slot-shaped opening along which the holder can move crosswise to the housing when the holder is being mounted in the housing or dismounted therefrom.

9 Claims, 12 Drawing Figures

SPRAYING DEVICE

The present invention relates to a spraying device comprising a spray nozzle holder which is designed to be mounted so that it may be rotated transverse to the spraying direction of the device, between a spraying position and a reversed position for blowing the nozzle clean, in a holder housing adapted to accommodate the said holder and preferably equipped with a contact shield, the holder having two mounting elements extending in opposite directions transverse to the housing, one of these elements being intended to bear a rotating handle.

A device of a similar type to that defined above is known from each of the following: U.S. Pat. Nos. 3,116,882, 4,116,386 and 4,165,836. All the devices of this type which are already known are structurally complicated. Mounting the spray nozzle in the holder housing and dismounting it therefrom have proved particularly inconvenient.

The main aim of the present invention is therefore to provide a device of the kind described above which solves the said problems.

This aim is achieved with a device according to the present invention which is basically characterised in that the housing has two openings substantially opposite to each other which are each designed to accommodate their respective said mounting element, at least one of the openings having a width which is less than the width of the holder in the vicinity of the nozzle, and that the housing is equipped with at least one slot-shaped opening along which the said holder is designed to be passed crosswise to the housing, when the holder is being mounted in the housing or dismounted therefrom.

Figure 1:
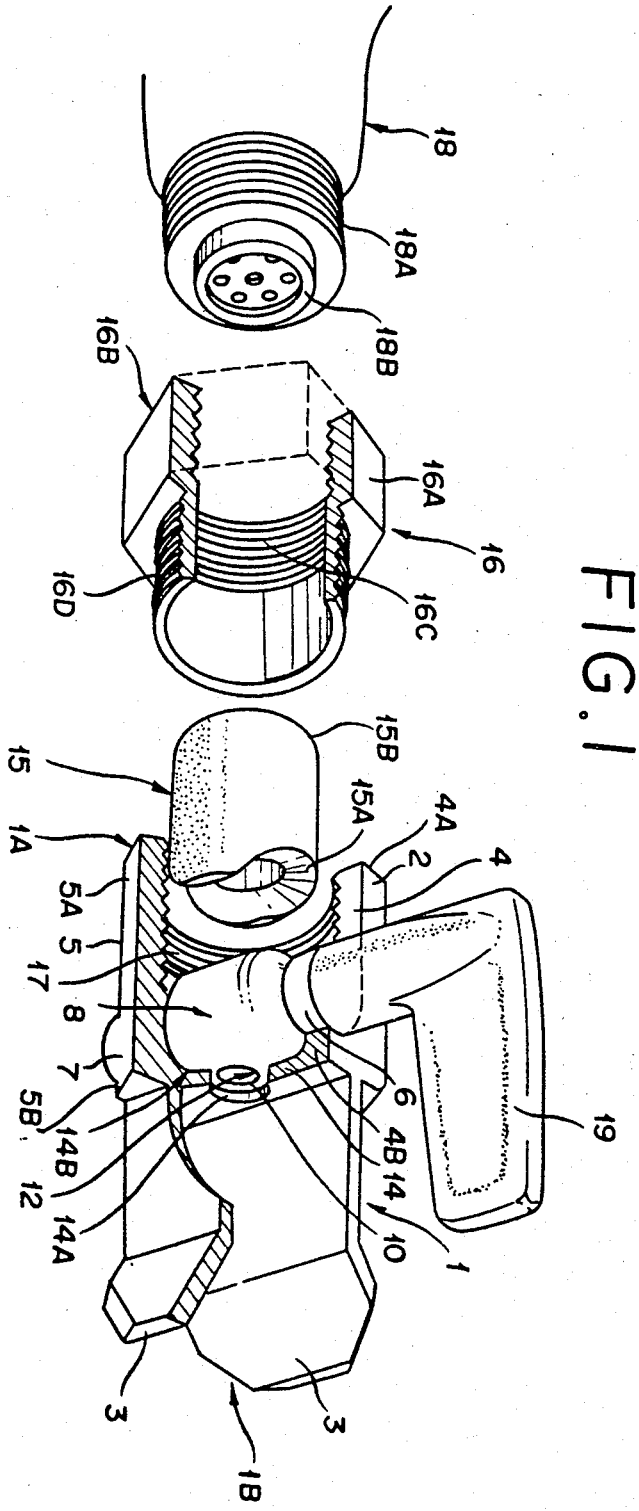
Figure 2:
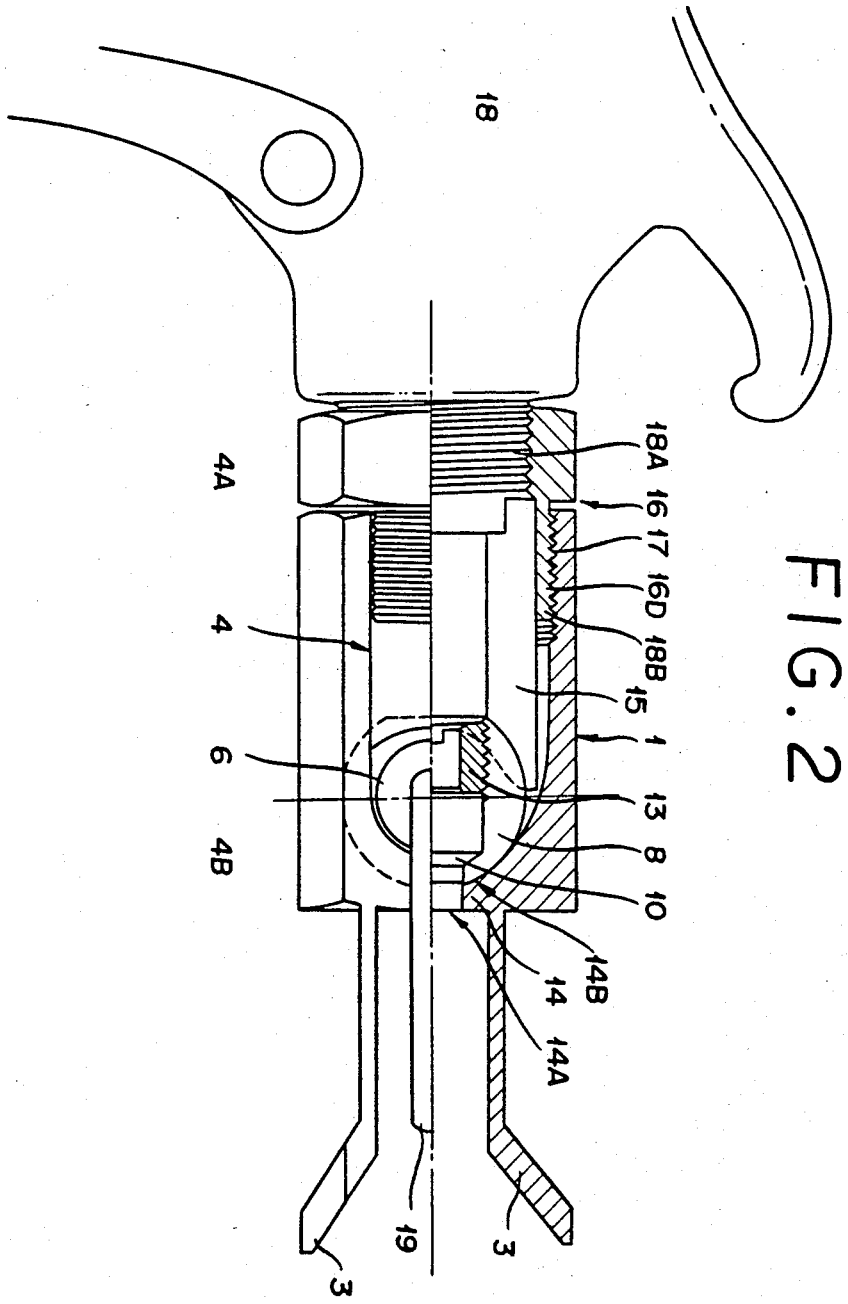
Figure 3:
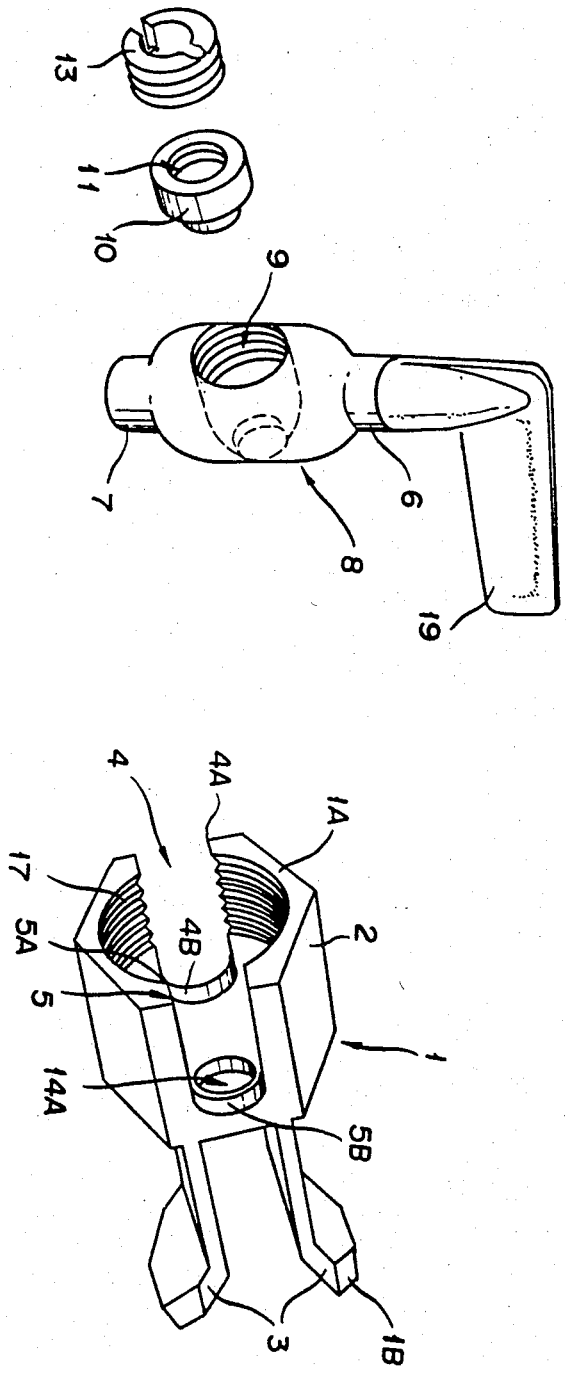
Figure 4:
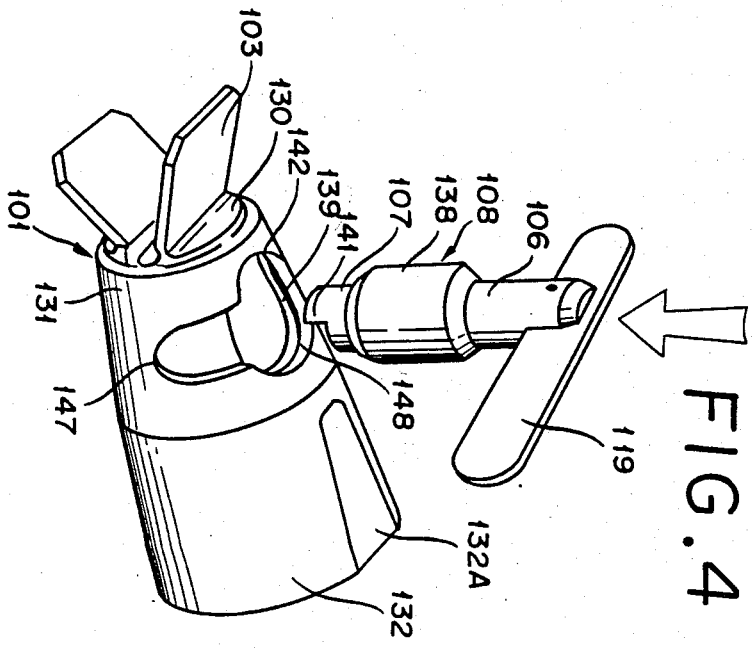

The invention is described in the following with reference to the accompanying drawings, on which FIGS. 1 to 3 show a first embodiment example of a spraying device constructed according to the invention, where FIG. 1 is an exploded view of parts appertaining to the device, FIG. 2 shows the device in a partially sectioned illustration, in the mounted state and ready for spraying, FIG. 3 shows the holder and the holder housing in the dismounted state, FIGS. 1 to 8 show another embodiment example of a spraying device constructed according to the invention, where FIG. 4 shows the device viewed in perspective, as it is being mounted.

Figure 4A:
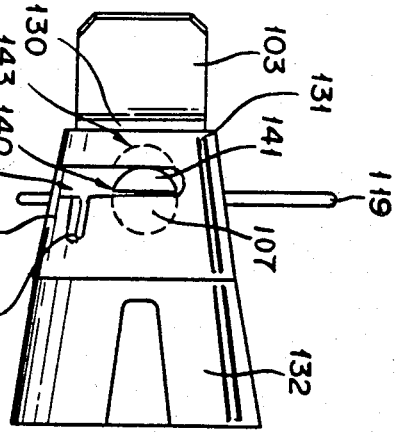
Figure 5:
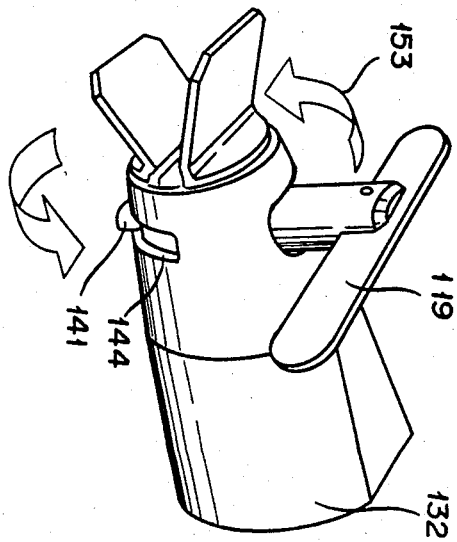
Figure 5A:
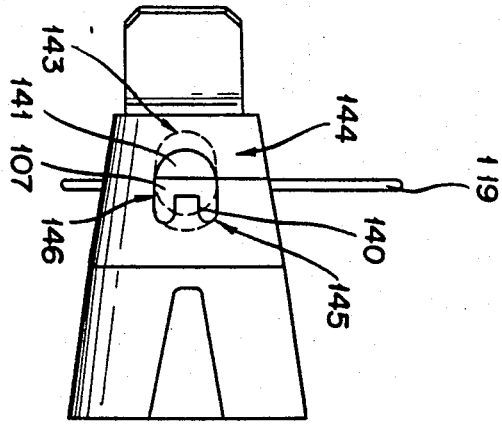
Figure 6:
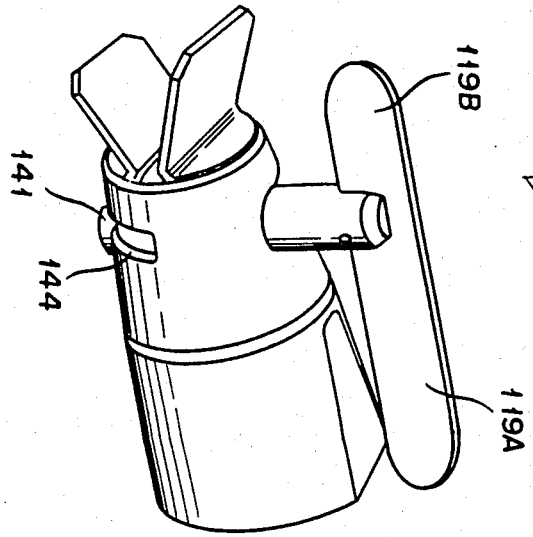
Figure 6A:
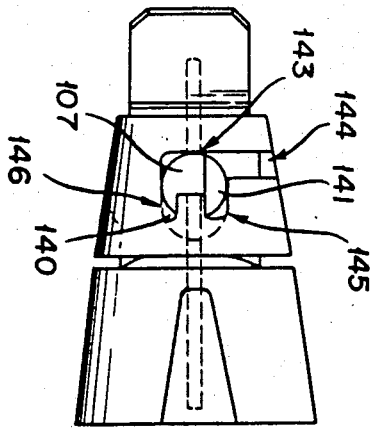
Figure 7:
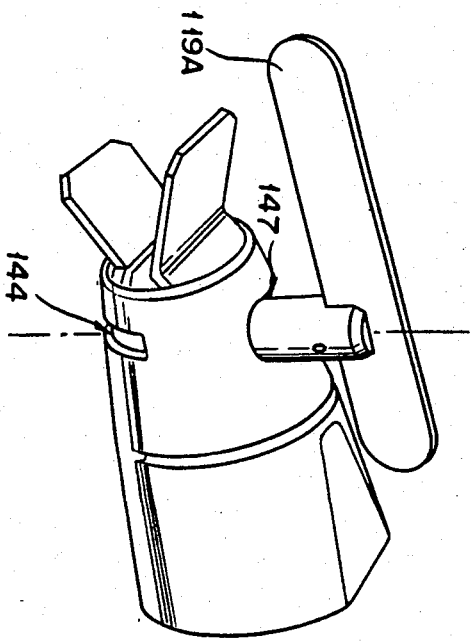
Figure 7A:
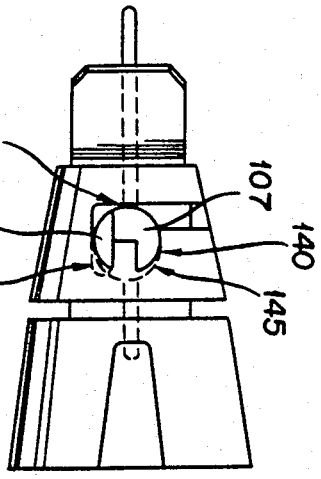
Figure 8:
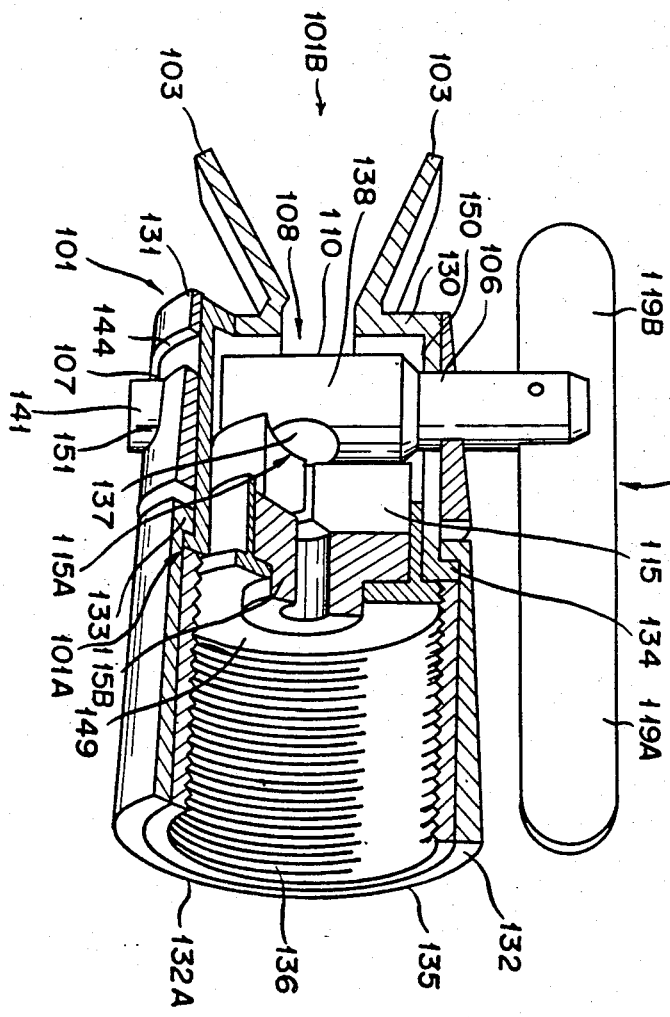

FIG. 4*a* shows the device during this process, viewed from the underside,

FIG. 5 shows the device in the mounted state, viewed obliquely from the front, FIG. 5*a* shows the device viewed from the underside, FIG. 6 shows the device with the handle on its spray nozzle holder rotated into the spraying position, for spraying with the device, FIG. 6*a* shows the device viewed from the underside, FIG. 7 shows the device with the spray nozzle holder handle rotated into the position for blowing the nozzle clean, FIG. 7*a* shows the device viewed from the underside, and FIG. 8 shows the device in a partially sectioned state.

Those elements in the said second embodiment example which are substantially the same as corresponding elements in the first embodiment example have been given corresponding reference symbols on the drawing, but with the addition of 100.

A holder housing which is designated 1 on the drawings is formed of a part with one end 1A which is referred to in the following as its rear end, on which it has a nut-type part 2 with internal threads. Its other end 1B, which will be referred to in the following as its front end, has two extensions 3 located at a mutual distance from each other and diverging at their respective free ends.

In the vicinity of the said nut-type part 2 the material of the housing 1 is traversed by two slot-shaped, elongated guideways 4 and 5 respectively. These two slots 4, 5, which are located diametrically opposite each other, extend in the longitudinal direction of the housing 1. One end section 4A and 5A respectively of the slots 4, 5 which form the guideways extends out to the outside while the other end sections 4B and 5B respectively, which are the front ends, extend up to a crescent-shaped part 4B, 5B which forms the mounting seat for the respective pins 6 and 7 which project in mutually opposite directions from a spray nozzle holder 8 transverse to the housing 1 when the holder 8 is mounted in the housing 1. The said holder 8 has a bore 9 which extends through the holder 8, transverse to its longitudinal direction. A nozzle 10 can be pushed into the bore 9 until it rests against the bottom section of the said bore 9 which is slightly constricted in the region where it emerges through the surface of the holder casing, to form a neck against which the front of the said nozzle can rest. This nozzle 10 is of a type which is already known per se and is preferably made of a wear-resistant material such as tungsten carbide, for example. The outlet of a delivery duct 11 which extends along the center axis of the nozzle 10 is preferably provided with a V-shaped recess 12 which is intended to provide effective dispersion of the material which is being delivered through the said outlet. A hollow locking screw 13 can be screwed into the bore 9 at the end furthest from the nozzle 10, to hold the latter securely.

In the region between the rear end 1A and the front end 1B of the housing 1 a through-flow bore 14A is provided through the material of a partition 14 located between them. The spray nozzle holder 8 has an external form such that, when it is mounted in the housing 1 and rests with its two pins 6, 7 on the respective mounting seats 4B, 5B, the circumferential part of the holder 8 is located at a distance from a part 14B of the said partition 14. The mounting of the holder 8 shown on the drawings in the housing 1 is effected by passing the holder 8 crosswise, with its respective pins 6, 7 accomodated in their respective guideway slot 4 or 5 in the housing 1. When insertion has been completed the pins 6, 7 rest against their respective mounting seat 4B, 5B. After this, a preferably elastic, preferably tubular sealing element 15 is inserted in the housing 1 from the rear end 1A, the front end of this sealing element having a bearing part 15A which is adapted to the exterior of the holder 8 and can be pressed against it. The rear end of the sealing element 15 also has a contact surface 15B which can be pressed against a pressure part. A fixing sleeve 16, which expediently has an external nut-type part 16A on its rear end 16B, is equipped with internal threads 16C at least in the vicinity of its rear end 16B. The front section of the sleeve 16 similarly has threads 16C which expediently differ from the said internal threads 16C with regard to pitch. The said sleeve 16 is designed to be inserted via its front end in the housing 1 and screwed fast to the housing 1 by means of the threads 16D, via threads 17 adapted to the said threads 16D and located inside the housing at its rear end 1A. After this, the sleeve 16, with the housing 1 supported by it and equipped with the holder, is screwed onto the delivery aperature of a spray gun 18, for example, by means of threads 16C on the sleeve 16 which thereby co-act with the threads 18A on the spray gun 18. As the sleeve 16 is being screwed onto the gun 18 its seal 15 is brought closer and when screwed on adequately it comes to rest with its rear end 15B on the front end 18B of the gun 18. The holder 8 is thereby pressed forward by the front end 15A of the seal so that the pins 6 and 7 respectively on the holder 8 come to rest on the mounting seats 4B and 5B respectively in the housing 1. By alternately screwing the housing 1, the sleeve 16 and the gun 18 relative to each other the housing 1 can easily be fixed in the required position so that the extensions 3 on it, which amongst other things serve as a contact shield, come into the correct position, while the seal 15 is still able to press the holder 8 until it rests in the correct position and seals against the holder 8, at the same time also sealing against the front end of the gun 18.

In the normal spraying position, i.e. the position wherein the holder 8, which has a manual manipulating handle 19 connected to the holder 8 and projecting therefrom transverse to the housing 1, is held in a rotary position such that the nozzle 10 is in an appropriate rotary position, medium such as paint, for example, which it is desired to deliver through the spraying device from the spray, can pass through the latter and be delivered out of the device and effectively distributed as a mist.

In the event of the passage 11 through the nozzle 10 becoming blocked by unwanted particles such as lumps and impurities in the paint, for example, the holder is rotated in the housing 1 right through 180° by means of the handle 19, so that the obstruction can be blown out of the passage 11 via its rear end. After this, the holder 8 is rotated back into its above-mentioned normal spraying position as shown on the drawing in FIG. 1.

The device, which consists of few separate parts, is easy to mount and dismount, and functions in an effective manner.

The embodiment example of the spraying device which is shown on the drawings in FIGS. 4–8 differs from the device described above primarily with regard to the mounting and locking of the spray nozzle holder in its associated holder housing. The said housing 101 is formed by two sleeve-shaped elements 130 and 131 which can be rotated relative to each other. At its front end 101B the inner sleeve 130 has two extensions 103 converging in the spraying direction, which are intended to form a contact shield for the device and to prevent accidental contact with the material which is being sprayed out of the device. At the back the housing 101 is connected to an internally threaded sleeve 132 which can be rotated relative to the inner sleeve 130 and which expediently engages via a part 133 at the rear end 101A of the housing 101 round a projecting part 134 of the inner sleeve 130. A connecting ring 135 with internal threads 136 is fixed inside the said sleeve nut 132 and is intended to co-act with a correspondingly threaded part on a spray-gun etc. which is not shown on the drawing.

A spray nozzle holder 108 is formed of a body with a spindle shape, for example, with an operating handle 119 fired to one of its ends and expediently made of a bar with rotating sections 119A and 119B which are of different lengths, in order to indicate more easily the position in which the valve 110 is set. The valve 110 is of a similar type to that in the embodiment example described above, and is held in place in the holder 108 by means of a plug-like component 137 provided with holes, which is expediently plugged into the holder 108 before the latter is machined to its final shape.

The ends of the holder 108 are formed of uniformly thick pins 106 and 107 respectively, one on each side of the center section 138, which has a larger cross-section and is equipped with a valve, the pins 106, 107 being designed to be mounted in respective diametrically opposed openings 139 and 140 respectively in the inner sleeve 130. One opening 139 has a larger cross-section that the center section 138 of the holder and therefore enables the holder 108 to be inserted through the said opening 139, which has a part 142 at its front end, intended to form a mounting for one of the pins, pin 106. The other pin 107 is intended to be mounted at the front end of the preferably slot-shaped opening 140 on a mounting part 143 which is adapted to the pin 107.

The outer end of the holder 108 which is located at the greatest distance from the handle 119 is constructed as a preferably segment-shaped end section 141. When the holder 108 is mounted in the housing 101, as shown in FIGS. 4 and 4A, the end section 141 is designed to be accommodated in a slot-shaped mounting opening 144 in the outer sleeve 131 which is preferably equipped with a conical outer casing. The slot-shaped mounting opening 144 extends in the circumferential direction of the sleeve 131 and at one end it has two openings 145 and 146 extending backwards and located at an appropriate distance from each other, resembling flags on the "flag-pole" slot 144; together, these resemble an "F" in mirror-image. The function of the openings 145, 146 will be explained later.

Substantially diametrically opposite the mounting opening 144 there is an opening 147 in the outer sleeve 131, extending in the shape of a slot over the circumference of the outer sleeve 131 and having a width over the major part of its length which slightly exceeds the width of the mounting pin 106. At one end of the slot the opening widens out into a preferably circular passage 148 which is wider than the intermediate nozzle mounting part 138 of the holder and enables the holder to be inserted as shown in FIG. 4, in the direction of the arrow.

The holder 108 is locked in the housing 101 by rotating the outer sleeve 131 so that the opening 147 which is narrower than the holder 108 comes in front of the opening 139 in the inner sleeve 130 and prevents the holder 108 from being pulled out. When the outer ring 131 is rotated, the end part 141 of the pin is simultaneously passed over the opening 144 to the vicinity of the two backwards-pointing openings 145, 146. A seal 115 equipped with a through-duct and possibly consisting of two parts made of plastic material, for example, is supported by a seal holder 149 which is inserted in the sleeve 132 from the rear end thereof and is intended to be acted upon by, for example, the front end of a spray gun in a similar way as in the first embodiment example described above, pressing the holder 108 towards the front part of the housing. The front part 115A of the seal 115 is adapted to the circumferential shape of the holder 108, while the rear end 115B is preferably formed by an elastically compressible part to enable it to absorb pressure from a co-acting part on the gun, etc. The seal 115 therefore strives to press the holder 108 forwards, so that the outer sleeve 131, which is slightly shorter that the section of the inner sleeve 130 on which it is mounted, is pressed forwards by the holder 108. A stop 150 which is located inside the front part of the sleeve 130 now co-acts with the thicker part 138 of the holder and holds the pin 107 in a position which is adjusted so that the edge part 151 of the mounting slots 145, 146 co-acts with the pin 107 and the pin end part 141 and prevents the outer ring 131 from being rotated.

However, as shown in FIGS. 6–7, it is possible to rotate the holder 108 so that the desired end of the nozzle device 110 points in the spraying direction, by manipulating the handle 119. When the handle 119 is held in a backwards-pointing position as shown in FIG. 6, the end part 141 is accomodated in the opening 145 and the nozzle 110 is turned in the spraying direction, ready for carrying out spraying by means of the device. By rotating the handle 119 in the direction of the arrow 152 so that it is set pointing in the spraying direction with the larger part 119A of the handle located as shown in FIG. 7; the end part 141 is rotated away from the opening 145 into the other opening 146 in the sleeve 131 so that it is accommodated therein, and the nozzle 110 can then be blown clear.

Dismounting the device is effected in reverse order, i.e. the grip section 132A on the sleeve nut 132 is gripped with a key and the device is released from the spray gun, after which the holder 108 can be rotated relative to the outer sleeve 131 in the direction of the arrow 153 in the rotary position shown in FIG. 4, and taken out of the holder 101 transverse to its longitudinal direction.

The invention is not restricted to the embodiment examples shown on the drawings and described above, but can be modified within the framework of the following Patent Claims. For example, the slot-shaped openings in the first embodiment example can be designed as a single opening which is adapted to the relevant cross-section shaping of the holder, and is arranged in the wall of the housing; the holder is introduced through this opening and then displaced crosswise in the longitudinal direction of the housing. It is also possible to provide openings which extend in the transverse direction of the housing, through which a holder is introduced in a similar way to that described above. The holder may expediently also be designed so that it normally strives to take up a position such that spraying through the device is made possible, for example due to a spring effect on it, or due to the provision of a pin with a stop which is designed to co-act with a corresponding stop on the housing. The threads on the housing can naturally be arranged on the outside instead of on the inside. It is also possible to attach the housing in another way than via threads, for example, by clamping. Similarly, the nozzle may be integrated in a holder like that described above. The holder is then preferably made of tungsten carbide or some other hard material. In this case, a single part forms the nozzle, the holder, the mounting pins and the handle, and manufacture of this part will preferably be by pressing. With a holder designed in this way there is no risk that the nozzle will be pushed out of the device somewhat freely, due to broken or worn partitions, fixing devices, etc. It is also expedient to provide slot openings on the housing in the first embodiment example so that the handle for the holder is located alongside an extension, i.e. rotated through 90° relative to the position shown in FIGS. 1–3. This effectively prevents the operator coming into the path of the spray jet while manipulating the handle, as shown in FIGS. 4–8.

I claim:

1. A spraying device comprising: a housing, a spray nozzle holder having a nozzle holding portion, and two mounting elements extending in opposite directions transverse to the housing, one of said mounting elements being adapted to bear a rotating handle, said holder being rotatable in said housing transverse to the spraying direction of said nozzle between a spraying position and a reversed position for blowing the nozzle clean, said housing having two openings substantially opposite to each other for accommodating respectively said two mounting elements, at least one of said openings having a width which is less than the width of said nozzle holding portion, said housing also having at least one slot-shaped opening in which said holder is movable transverse to said housing when said holder is being mounted in, or dismounted from, said housing.

2. A device according to claim 1, comprising a sealing element having one end with a sealing surface adapted to be pressed against a circumferential surface of the holder.

3. A device according to claim 2, wherein the sealing element has another end with a contact surface adapted to be pressed against a pressing part which is pushable relative to said housing towards the holder, and which permits said sealing element to be pressed against said holder.

4. A device according to claim 2, comprising a sleeve nut equipped with threads and rotatable relative to said holder to co-act with a fixing part equipped with complementary threads for securing said device and for pressing the sealing element against said holder.

5. A device according to claim 1, wherein said housing is formed by an inner and an outer sleeve-like element, said elements being rotatable relative to each other, the circumference of said outer element being provided with two said slot-shaped openings.

6. A device according to claim 5, wherein said outer sleeve has mounting openings located in the vicinity of said slot-shaped openings for accommodating an end part of said mounting element remote from the element adapted to bear a handle, said mounting openings forming an "F" in mirror-image, with a leg disposed in the direction of rotation of said outer sleeve.

7. A device according to claim 6, wherein said end part has a segment-shaped cross-section corresponding to said mounting openings, said end part being receivable in one of said mounting openings in the spraying and reversed position, respectively.

8. A device according to any one of claims 5 to 7, wherein said inner sleeve element has a stop for cooperating with a part of the holder in said spraying position, and for retaining said holder in an inserted position of said end part for cooperating with edge parts on said mounting openings to prevent said two sleeve elements from rotating relative to each other and from releasing said holder.

9. A device according to any one of claims 1 and 5 to 7, wherein said spray nozzle holder forms an integrated part with a handle and said mounting elements, said adapted to be inserted in said housing, and a nozzle in said holder.

* * * * *